US007484339B2

(12) United States Patent
Fiehler

(10) Patent No.: US 7,484,339 B2
(45) Date of Patent: Feb. 3, 2009

(54) PANELIZED WALL CONSTRUCTION SYSTEM AND METHOD FOR ATTACHING TO A FOUNDATION WALL

(76) Inventor: Raymond H. Fiehler, 1984 Oberlin Dr., Apt. 108, Maryland Heights, MO (US) 63146

( * ) Notice: Subject to any disclaimer, the term of this patent is extended or adjusted under 35 U.S.C. 154(b) by 543 days.

(21) Appl. No.: 11/162,636

(22) Filed: Sep. 16, 2005

(65) Prior Publication Data

US 2007/0074485 A1 Apr. 5, 2007

(51) Int. Cl.
*E04B 1/00* (2006.01)

(52) U.S. Cl. ..... 52/742.14; 52/295; 52/293.3; 52/126.3

(58) Field of Classification Search ..... 52/295, 52/293.3, 126.1, 126.3, 742.14, 742.15
See application file for complete search history.

(56) References Cited

U.S. PATENT DOCUMENTS

| | | | | |
|---|---|---|---|---|
| 749,812 | A | 1/1904 | Buente et al. | |
| 2,244,343 | A | 6/1941 | Meyercord | |
| 2,328,823 | A | 9/1943 | MacKenzie | |
| 3,204,381 | A | 9/1965 | Perreton | |
| 3,378,969 | A | 4/1968 | Larger | |
| 4,104,885 | A | 8/1978 | Thomas | |
| 4,315,385 | A * | 2/1982 | Moreau et al. | 220/585 |
| 4,320,612 | A | 3/1982 | Jeffries, Jr. | |
| 4,688,364 | A | 8/1987 | Fiehler | |
| 4,697,395 | A * | 10/1987 | Peek | 52/167.1 |
| 5,487,241 | A * | 1/1996 | Gorrell et al. | 52/79.1 |
| 5,666,774 | A * | 9/1997 | Commins | 52/298 |
| 5,882,564 | A | 3/1999 | Puppin | |
| 6,226,849 | B1 * | 5/2001 | Beck et al. | 29/407.05 |
| 6,305,134 | B1 * | 10/2001 | Robinson | 52/299 |
| 2001/0023563 | A1 * | 9/2001 | Phillips | 52/292 |
| 2003/0051424 | A1 * | 3/2003 | Rainbolt | 52/302.1 |

FOREIGN PATENT DOCUMENTS

JP 2001241179 A * 9/2001

* cited by examiner

*Primary Examiner*—Richard E Chilcot, Jr.
*Assistant Examiner*—Alp Akbasli
(74) *Attorney, Agent, or Firm*—Husch Blackwell Sanders LLP

(57) ABSTRACT

An improved panelized construction system for providing a wall formation for attaching to a foundation wall including a plurality of block forming units adaptable for being both vertically and horizontally arranged to form the wall formation, the opposed side wall portions of each unit including cooperatively engageable portions for fixedly attaching the units in side-by-side horizontal relationship. The present methods for attaching the assembled wall formation to at least a portion of a foundation wall includes providing a plurality of adjustment mechanisms for enabling the wall formation to be leveled and aligned with adjacent wall formations or other structures independent of any foundation misalignments, and providing a plurality of foundation cavities adjacent the upper edge portion of the foundation wall for receiving corresponding foot members associated with the wall formation for encapsulation in a cement slurry.

25 Claims, 5 Drawing Sheets

PANELIZED WALL CONSTRUCTION SYSTEM AND METHOD FOR ATTACHING TO A FOUNDATION WALL

BACKGROUND OF INVENTION

This invention relates generally to building constructions and prefabricated wall systems and, more particularly, to an improved panelized wall construction system which is easy to assemble, which lends itself to several more efficient methods of installation including energy efficiencies, and which provides an easy method for achieving wall alignment independent of foundation misalignments which might have occurred during pouring of the foundation.

Most modern residential and light commercial designs use platform framing. Platform framing is the skeleton of the house that provides the structure needed to attach the other house components and transfer the weight through the foundation to the ground. With this type of framing, each floor is built as a supported platform with the walls constructed separately and attached to the top of the platform. The first floor is built on top of the foundation walls like a "platform". The foundation is the footprint of the house or other structure that is in contact with ground. The foundation performs the function of spreading the structural load over a wider area and preventing differential settling of the structure. FIG. 1 is a representative illustration of conventional platform framing where the first floor is built on top of a conventional foundation wall. This framing typically includes sill plates, floor joists, rim boards, sub-flooring, soleplates and so forth as illustrated in FIG. 1. The walls are then constructed and raised on the platform as illustrated in FIG. 1 and the second story floor or platform is built on the raised walls. This process is repeated for each additional floor. Although this type of construction provides a safe and simple form of building, it is time consuming.

Shrinkage, expansion and contraction due to variations in temperature and humidity, seismic vibrations, sonic booms, thunder claps and high winds are all factors that will distort the foundation framing section of a house or other structure and will cause such structure to vibrate and move. A structure never goes back exactly to its original state once one of these events occurs. Such micro movements of a wall with respect to the foundation, over time, will produce small openings therebetween such as gaps between the foundation wall and the sill plate, between the sill plate and the rim board and/or floor joists, between the sub-floor and rim board and/or the soleplate and so forth, all of which will provide a path for unwanted air exchange between the inside and outside air. In the past, this unwanted air infiltration may not have been important but with high fuel prices, these subtle details now become important and with the advent of energy conservation, air flow leakage paths and leakage rates must now be addressed. Thus a new way to attach the wall portion of a structure foundation is also imperative.

In view of the ever-escalating costs of construction for both residential and commercial purposes, and in view of energy considerations, there has been an ongoing effort in the construction industry to develop wall systems which may be relatively economically fabricated and assembled offsite and thereafter transferred to the construction site for quick and easy integration into the onsite building process. It is intended that the prefabricated wall systems would replace the onsite board-by-board platform framing and finishing process currently in use while still maintaining strength, stability, and wall integrity.

Although panelized wall construction is well known in the industry, efforts to modernize and industrialize residential and commercial construction using a panelized wall construction system has had limited success. Whereas automobiles, appliances and electronic devices have been factory automated for many years, residential and commercial construction remains primarily an onsite activity using stick-built platform framing construction methods.

Applicant's U.S. Pat. No. 4,688,364 discloses one such panelized construction system for wall formation which utilizes a plurality of block forming units which can be arranged in vertical, side-by-side rows, with endwise abutment between adjacent rows of such units, positively interengaging components being provided on the confronting ends of each block forming unit for joinder with an adjacent unit. Adhesion between the block forming units of one row and those of each adjacent row are affected by both cementitious material as well as wall expanding and contracting units which are provided within the wall formation. This system also uses a cooperatively engageable pin and bore arrangement for likewise affecting joinder. Although this system provides sturdiness, wall integrity and safety, it does utilize three differently constructed block forming units which must be properly arranged in a specific order in order to achieve the desired effects such as to permit facile expansion and contraction of the structure responsive to atmospheric conditions. Although this panelized construction offers great potential including reduced construction cycle time and improved framing quality and energy conservation, it's more complicated assembly process has hindered industry implementation.

If successfully implemented, panelized wall constructions can provide a wide range of benefits to the construction industry by relocating wall framing operations from the construction site to a controlled factory environment. Factory operations can be optimized and automated for mass production of wall panels that are engineered to meet all structural and performance-based specifications. In addition, a factory environment can provide methods for more efficient utilization of materials and human resources.

It is therefore desirable to provide an improved panelized wall construction system which overcomes many of the shortcomings and disadvantages of present wall construction systems and which is easy to assemble; it is susceptible to mass production in a factory environment; it is susceptible to computerized assembly; and it is susceptible to accommodate intricate architectural details. It is also desirable to provide an improved panelized wall construction system which provides means to correct wall misalignment during onsite assembly independent of foundation misalignments that might have occurred during the building process, which provides a convenient electrical chase which allows for the inclusion of shock absorbers to isolate the structure from the foundation in areas of seismic activity, which provides a capillary break or moisture barrier to prevent moisture seepage, and which lends itself to several more efficient methods of installation and attachment to a foundation wall.

SUMMARY OF INVENTION

The technology of manufacturing wall panels in a factory or other off-site location and then delivering such wall panels to the construction site for assembly and integration into the building project is known as panelized construction. The present panelized construction system utilizes a plurality of substantially similarly constructed block forming units which can be both vertically and horizontally arranged to form a wall structure of any particular design. Each block forming unit includes cooperatively engageably means associated with opposed side portions thereof for interlocking engagement with each other in a side-by-side arrangement. One opposed side portion of each block forming unit includes a substantially U-shaped channel or cavity for cooperatively receiving a corresponding projection associated with the other opposed side portion of an adjacent block forming unit. The cooperatively engageable projections and cavities provide an extensive surface for applying a suitable adhesive for attaching the block forming units in a side-by-side arrangement. As will be hereinafter explained, one side portion of each block forming unit includes the receiving cavity or channel whereas the opposed side portion of each block forming unit includes the cooperatively engageable projection. The opposed end portions of each block forming unit are substantially similar in construction and provide smooth mating surfaces for likewise adhesively attaching the present block forming units in a vertical arrangement.

Although the present block forming units are substantially similar in construction, it is preferred that these units be provided in different lengths so that when integrated into a wall formation, the block forming units will be arranged in an offset or staggered relationship to immediately adjacent blocks for improving the strength and stability of the overall wall formation. In addition, the present block forming units may be made of any desired material of construction and are particularly adaptable for formation using fibrous material such as virgin or waste fibers, particle board furnish and other similar materials which can be combined and/or bound by suitable adhesives, binders and/or resins and thereafter formed through an extrusion process. Thermoplastic and, preferably, thermosetting resins are particularly suitable for use in the construction of the individual block forming units. In addition, the present block forming units may be hollow in construction to reduce the overall weight of each unit and, if desired, each block forming unit may be filled or packed with suitable insulation or other materials for stability, strength, weather and other purposes.

In one embodiment of the present panelized construction system, a plurality of adjusting screws or other similar mechanisms are positioned and arranged along the upper edge surface of the foundation wall upon which each respective panel wall section will rest. The adjusting screws enable the users to accurately align adjacent wall forming panels when positioned in side-by-side relationship to each other. If adjacent panels are offset from each other and/or tilted in any manner due to a wide variety of different reasons such as foundation misalignments and/or unevenness, adjustment of the appropriate adjustment screws will quickly and easily align adjacent wall panels independent of any inaccuracies in the pouring of the foundation or other reasons causing the misalignment. Because adjustment screws are utilized adjacent the top edge portion of the foundation wall, a gap does result between the foundation and the bottom edge portion of each respective wall section. Although unconventional, this gap serves a number of beneficial functions such as providing space for a convenient electrical chase, providing a capillary break between the foundation wall and the wall sections to prevent moisture seepage, providing a means for installing additional insulating foam or other material between the foundation wall and the wall sections to increase energy efficiency, and other beneficial functions which will be hereinafter explained.

In another embodiment of the present panelized construction system, a plurality of spaced apart cavities are formed in the foundation wall adjacent the top edge portion thereof, each cavity being adaptable for receiving a corresponding foot or downwardly projecting member associated with the bottom edge portion of each respective panel wall section. Each foundation cavity is filled with a cement slurry and the respective panel wall section is positioned over the foundation wall such that the corresponding foot members are received within the foundation cavities and suspended therewithin until the slurry hardens. Wedge support blocks are used to hold and support the wall section above the foundation wall at the proper height to both level and align the panel section relative to an adjacent panel section and to allow the panel foot members to extend into the cement slurry to the proper depth. Once the cement slurry is sufficiently hardened, the wedge support blocks may be removed. Anchoring the panel foot members in slurry filled foundation cavities isolates any movement of the wall panel section relative to the foundation. The resulting gap formed between the foundation wall and the bottom edge portion of each respective wall section fulfills the same beneficial functions as referenced above and which will be hereinafter further explained.

Because of the simplicity of the present block forming units, formation of a wide variety of different wall systems can be optimized and automated for mass production. In addition, the present wall systems are easily combined with existing roof and floor systems and the present panelized construction can be utilized for both interior and exterior wall systems.

These and other aspects and advantages of the present invention will become apparent to those skilled in the art after considering the following detailed description in connection with the accompanying drawings.

BRIEF DESCRIPTION OF DRAWINGS

For a better understanding of the present invention, reference may be made to the accompanying drawings.

DETAILED DESCRIPTION

Figure 1:
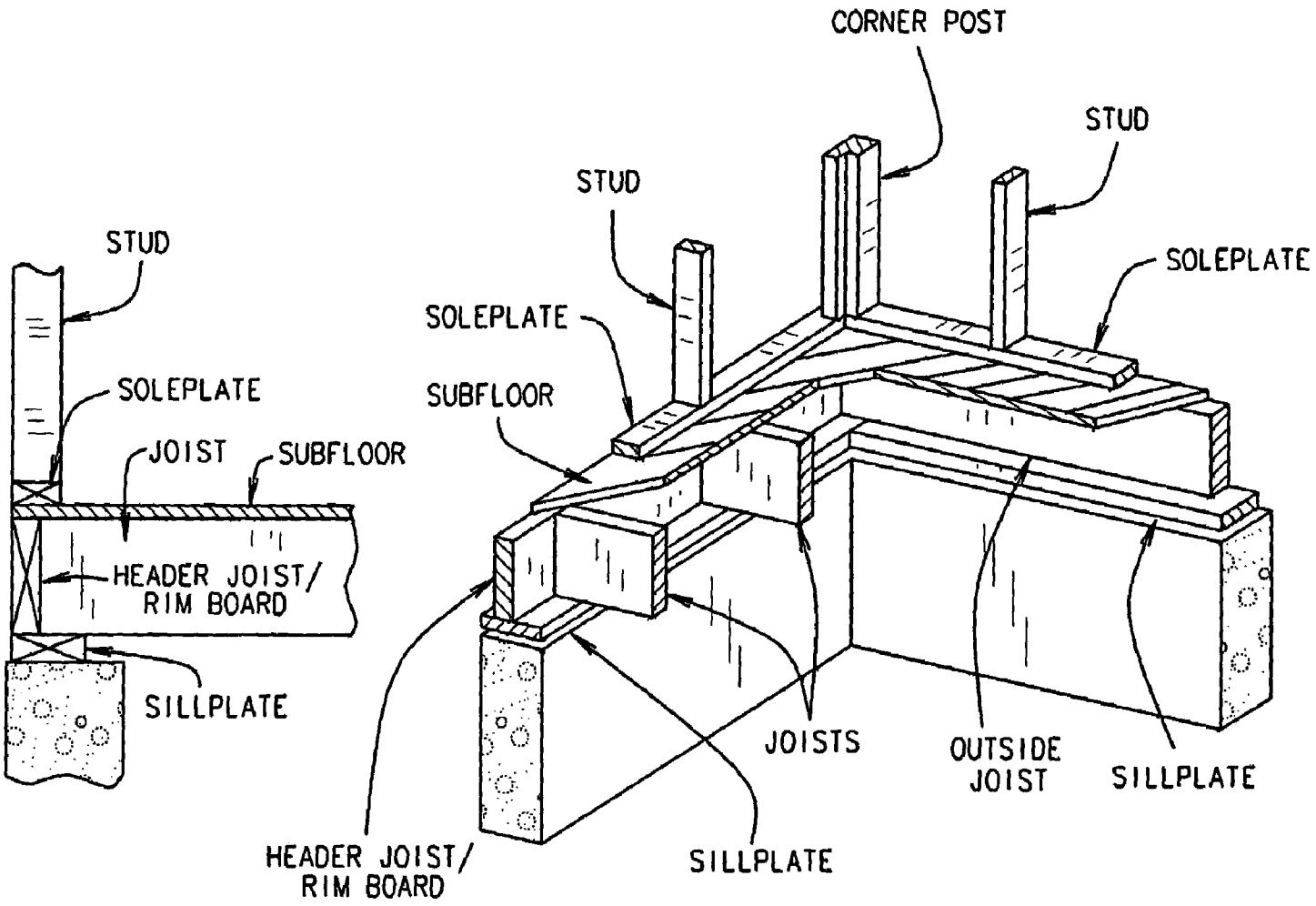
FIG. 1 PRIOR ART
FIG. 1 is a representative illustration of conventional prior art platform framing constructed on top of a foundation wall.
Figures 2, 3:
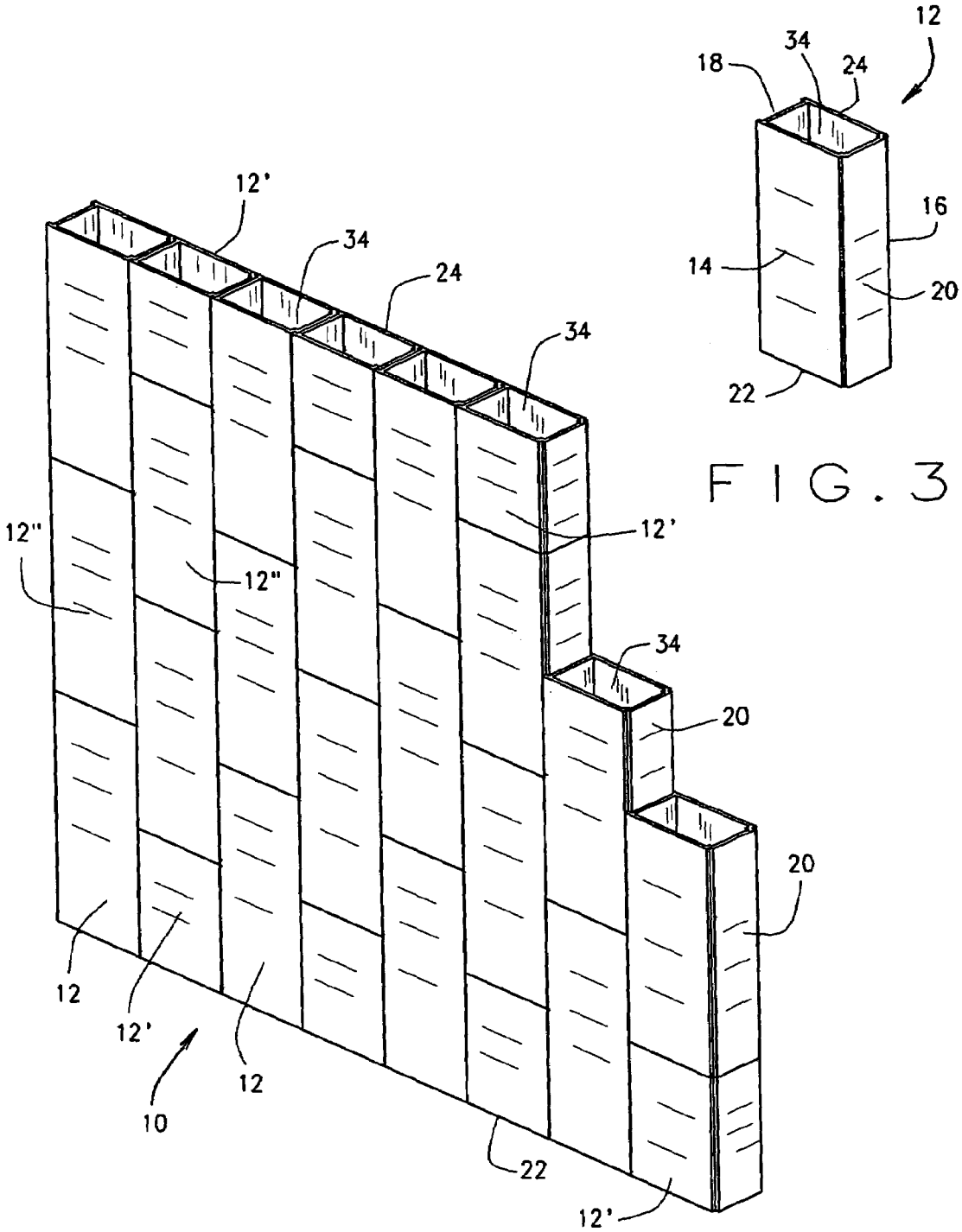
FIG. 2 is a fragmentary perspective view of a planar wall section constructed in accordance with the teachings and practice of the present invention.
FIG. 3 is a perspective view of one of the present block forming units constructed in accordance with the teachings of the present invention.

Referring to the drawings more particularly by reference numerals wherein like numerals refer to like parts, number 10 in FIG. 2 identifies one embodiment of a panelized wall formation constructed according to the teachings of the present invention. The panelized wall formation 10 is of a planar configuration and is comprised of integrated unitary blocks or block forming units 12 which are positioned in both a side-by-side horizontal relationship and a vertically stacked relationship so as to achieve a particular wall panel size and shape. The block forming units 12 are illustrated herein as being of a hollow or void-developing shape, but it is recognized and anticipated that the blocks 12 may likewise be solid in overall construction, if so desired. The hollow shape of each block forming unit 12 is advantageous in that it reduces the overall weight of each such unit and thereby facilitates ease in handling and positioning both at the factory and at the construction site.

Figure 4:
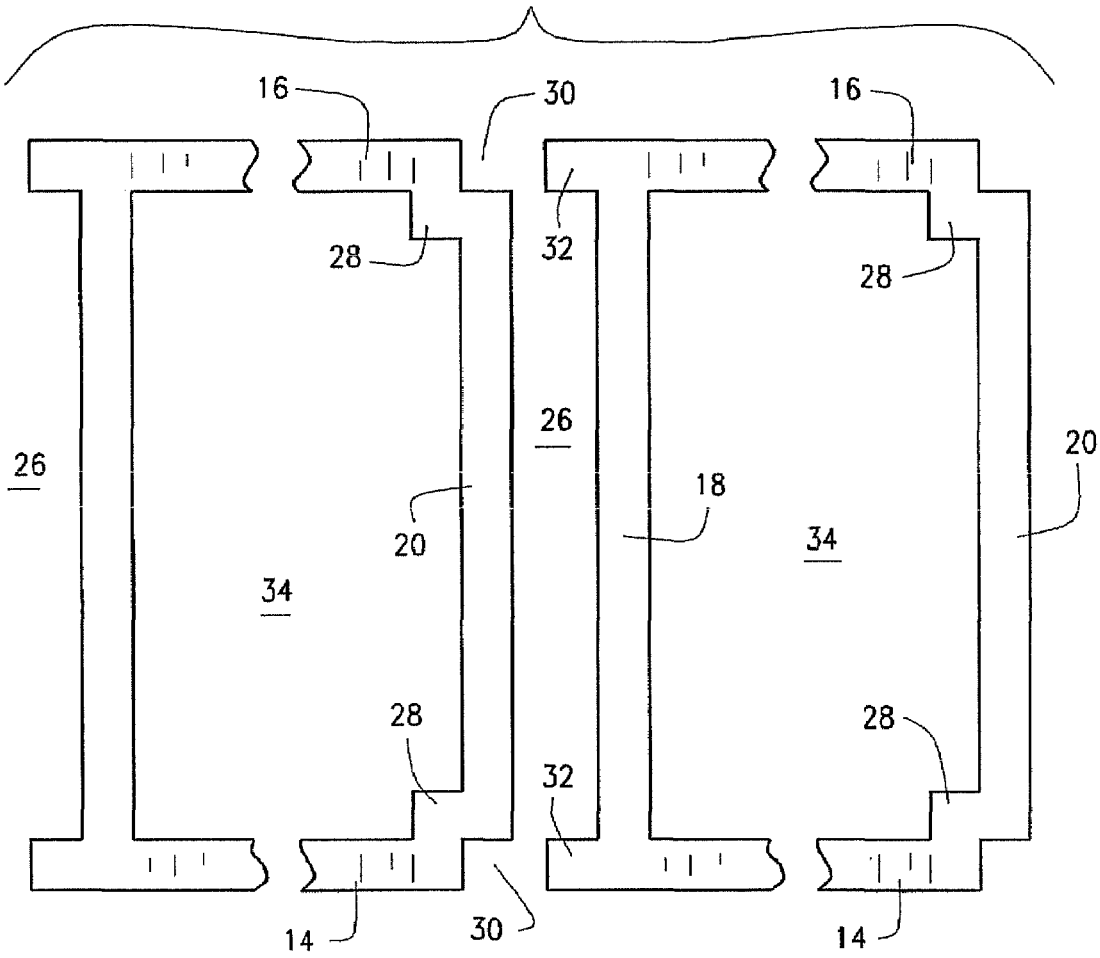
FIG. 4 is a fragmentary top plan view illustrating the side-by-side joinder of two adjacent block forming units constructed in accordance with the teachings of the present invention.

As best illustrated in FIG. 3, each individual block forming unit 12 includes opposed front and rear wall portions 14 and 16, opposed first and second side wall portions 18 and 20, and opposed first and second end wall portions 22 and 24. The opposed front and rear walls 14 and 16 are substantially planar and form the respective front and rear wall surfaces of a completed wall formation. As best illustrated in FIG. 4, side wall 18 is spaced inwardly from the adjacent end surfaces of front and rear walls 14 and 16 so as to define therebetween a generally U-shaped outwardly opening channel, cavity or recess 26. The side portions of the recess 26 is thus developed by the adjacent end portions of front and rear wall portions 14 and 16, the side wall portion 18 likewise being generally planar in configuration and presenting a substantially flat smooth surface for engaging the opposed planar side wall portion 20 as will be hereinafter explained.

In contrast to side wall portion 18, opposed side wall portion 20 is stair-stepped adjacent the front and rear wall portions 14 and 16 as at 28 so as to extend beyond the adjacent end surfaces of front and rear wall portions 14 and 16. The side wall portion 20 represents a protecting planar surface which is sized and shaped so as to be cooperatively received within the channel or recess 26 associated with the opposite side portion of each respective block forming unit 12. Side wall portion 20 likewise presents a substantially smooth mating surface for joinder with side wall portion 18. The stair-step arrangement 28 associated with side wall portion 20 likewise forms a space, channel or shoulder 30 adaptable for cooperatively receiving the adjacent end portions 32 associated with the front and rear wall portions 14 and 16 which extend beyond side wall portion 18. As a result, when two block forming units 12 are positioned in side-by-side relationship to each other such that the side wall 18 of one block 12 is positioned adjacent side wall 20 of the adjacent block 12, projection 20 will be cooperatively received within the recess 26 and the end wall portions 32 will be cooperatively received within the channels or shoulder 30. When so positioned, the front and rear side walls 14 and 16 associated with each respective block forming unit 12 will be substantially contiguous with each other thereby forming a substantially flat planar wall surface. As best illustrated in FIGS. 2-4, the wall portions 14, 16,18 and 20 associated with each block forming unit 12 cooperate with each other so as to define a central void 34 extending the length of each respective block 12.

Joinder of the respective block forming units 12 in both a side-by-side horizontal arrangement as well as in a vertically stacked arrangement is accomplished strictly by adhesive or cementitious means. In this regard, when a plurality of block forming units 12 are positioned in side-by-side relationship as illustrated in FIG. 4, the entire wall surfaces of wall portions 18 and 20 as well as the wall portions forming the shoulder 30 and end wall portions 32 may be adhesively coated with an appropriate adhesive or cementitious material to accomplish side-by-side joinder. In similar fashion, the top and bottom end surfaces of each block forming unit 12 are likewise coated with an adhesive or cementitious material so as to affect joinder of adjacent blocks when positioned in a vertically stacked arrangement one on top of the other. Suitable adhesive materials for accomplishing this joinder and for accomplishing the strength, stability and durability of such joinder are well known in the industry. In addition, unlike existing pre-fabricated wall systems, no pins, apertures, or other interlocking mechanisms are utilized in the present construction. This greatly simplifies joinder of one block forming unit relative to another and lends itself to computerized construction as will be hereinafter explained. In addition, since all of the present block forming units 12 are substantially identical in construction, panelized wall formations can be easily constructed to include any architectural requirements and specifications including framing for any number of windows, doors, and other apertures/openings and applications.

As best illustrated in FIG. 2, the block forming units 12 are preferably of at least two different lengths such as the blocks 12' and 12" so that when integrated into a composite wall formation the blocks will be arranged in an offset or staggered relationship to each other thereby increasing the strength and overall stability of a pre-fabricated wall section. As illustrated in FIG. 2, the block forming units 12 are disposed in vertical rows with the blocks of length 12' and 12" alternating with the alternation in any one row being opposed to that in immediately adjacent rows. This staggered or offset arrangement increases the collapse-resistance of the completed panelized wall construction. Appropriate side panels (not shown), and even appropriate end panels (not shown), can be utilized in conjunction with any completed wall formation if any one opposed side or opposed top and bottom portion of the completed wall construction is exposed for any reason after integration into the building project. These additional side and end panels can be similarly constructed to mate with the appropriate side or end portion to which it will be attached and such additional panels can be adhesively attached thereto as previously explained with respect to the block forming units 12.

As previously indicated, the block forming units may be made of any desired material of construction. However, it is important to note that a particularly suitable material, from one standpoint of economy and durability, is fibrous material as obtained from virgin or waste fibers such as, for instance, sawdust, to which may be added other waste materials such as news print, scrapped cardboard and so forth, with the same being bound by a suitable adhesive and then formed through extrusion.

It is also recognized that the present block forming units 12 can be constructed using particle board furnish mixed with appropriate resins to produce a composite matrix of material which can be extruded to form the block 12. In this regard, although a thermoplastic elastomer or other thermoplastics can be used as part of the composite forming matrix material, thermoplastics are susceptible to deformation under certain temperature conditions. U.S. Pat. No. 5,882,564 discloses one example of a resin and wood fiber composite profile which can be used in an extrusion method for fabricating structural members. Composite materials can be made from a matrix forming material such as a thermoplastic and a reinforcement for the matrix such as a fiber. The components can be added separately to the member forming process or combined to form a pre-prepared composite feed stock. Such members can comprise any structural unit or portion thereof. The composite materials disclosed in U.S. Pat. 5,882,564 can be used to form structural members such as rails, jambs, stiles, sills, tracks, stop and sash, and other structural components used in windows, doors, and other structural members. Other examples of extruded thermoplastic materials which can be used as an extruded composite material to form the present block forming units 12 are likewise well known in the industry.

It is also recognized and anticipated that although thermoplastic materials are available for use in the fabrication and construction of the blocks 12, it is generally preferable that such extruded composite matrix material have thermoset characteristics. For example, ureaformaldehyde resins are the most prominent examples of the class of thermosetting resins usually referred to as amino resins. Urea-formaldehyde resins constitute the majority of the amino resins produced worldwide. Melamine-formaldehyde resins constitute the remainder of this class of resins, except for minor amounts of resins that are produced from other aldehydes or amino compounds, or both. Amino resins are used in the production of adhesive for bonding particle board, medium-density fiber board, hardwood plywood, and a laminating adhesive for bonding, for example, furniture case goods, overlays to panels, and interior flush doors. Amino resins are often used to modify the properties of other materials and are added during the processing of such products to impart permanent press characteristics. Other thermosetting wood adhesives include phenol-formaldehyde and polymeric diisocyanates. Still other thermosetting fiber or wood adhesives are well known in the industry and can be utilized in the extrusion process for forming the present block forming units 12. Thermosetting materials are generally preferred over thermoplastic materials because of their toughness, durability, and their ability to resist melting or other deterioration under a wide variety of different temperature conditions. Still other thermosetting materials more conducive to exterior use are likewise well known in the industry.

Although thermoplastic and thermoset materials as well as a wide variety of other materials can be used in the formation of the present block forming units 12, it is also recognized and anticipated that all of the materials of construction discussed herein are for illustrative purposes only, and such materials may vary depending upon the particular application involved. Also, with respect to the use of fibrous material, such use is not critical for the development of pre-fabricated wall structures in accordance with the teachings of the present invention.

Figure 5:
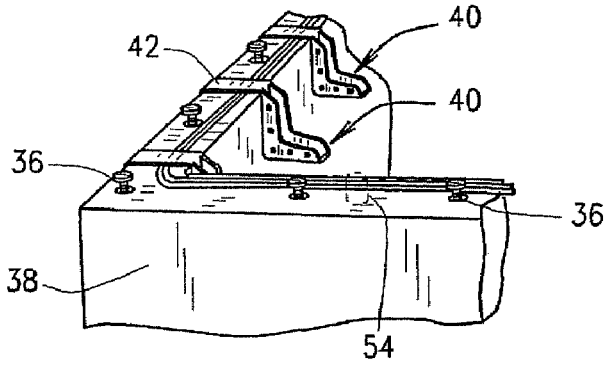
FIG. 5 is a fragmentary perspective view of one embodiment of the present system and method illustrating use of the present adjusting screws and typical floor joist hangers which can be utilized in conjunction with a wall panel section formed in accordance with the teachings of the present invention for attaching onto a typical foundation wall.
Figure 6:
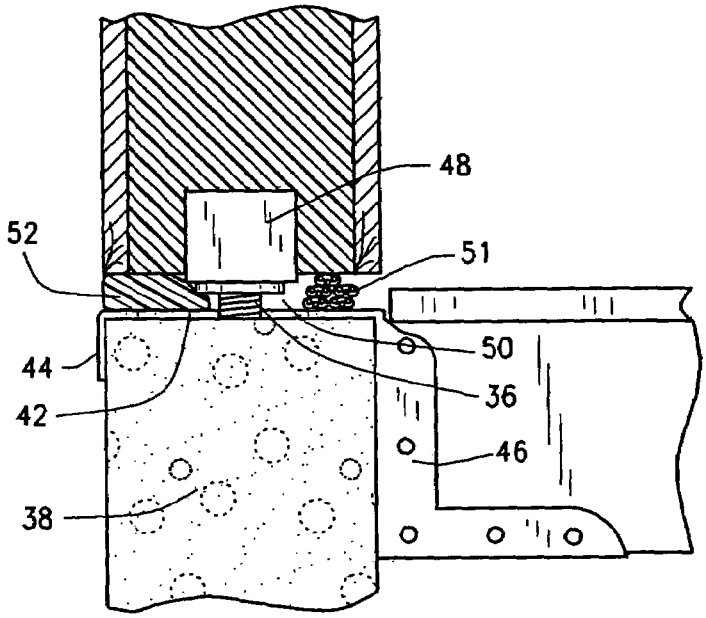
FIG. 6 is a partial side elevational view illustrating the embodiment of the present method of FIG. 5 for installing a panelized wall system constructed in accordance with the teachings of the present invention onto a typical foundation wall.

FIGS. 5 and 6 illustrate one embodiment of the present system and method for assembling and integrating any plurality of pre-fabricated panelized wall formations or panel constructions constructed in accordance with the present invention into a building project. As illustrated in FIG. 5, the present system and method utilizes a plurality of adjustment screws 36 which are positioned and arranged in spaced apart relationship along the walls associated with a typical foundation 38 to which the panelized wall constructions 10 will be attached. The adjusting screws or other equivalent adjustment mechanisms 36 are attached or otherwise seated into the foundation wall by conventional means. The adjustment mechanism 36 is capable of moving up and down in a vertical direction for purposes which will be hereinafter explained. The spacing between the respective adjustment screws 36 will depend upon the size and weight of the specific pre-assembled wall formation which will be attached thereto.

FIG. 5 also illustrates a typical floor joist hanger 40 which can be utilized with the present system. The floor joist hangers 40 include bracket or flange portions 42 and 44 as best illustrated in FIG. 6. Flange portion 42 extends along the upper top surface of the foundation wall 38 whereas flange portion 44 extends downwardly on the back wall surface of foundation 38 as best shown in FIG. 6. Floor joist hanger 40 is preferably integrally formed although bracket portions 42 and 44 can be attached by conventional means to the L-shaped hanger portion 46. The floor joist hangers 40 can be attached to the foundation walls 38 by conventional means well known in the industry. Bracket or flange portion 42 is designed so as to lie within the space or gap 50 formed between the top portion of foundation wall and the panelized wall construction 10 as will be further described with respect to FIG. 6. This construction does not interfere with the adjustment of the adjustment screws 36 in the vertical direction. It is also recognized and anticipated that other floor joist hanger constructions adaptable for use with the present system which will not interfere with the adjustment of the adjusting screws 38 can likewise be utilized.

FIG. 6 illustrates the attachment of a typical panelized wall construction 10 to a foundation wall 38. A support flange or clip member 48 is attached to the upper surface of the adjustment screw 38 by conventional means. The support flange member 48 can be U-shaped, L-shaped, or can take on any other configuration so long as support flange 48 can be suitably attached or cooperatively engaged to the panelized wall construction 10 which will mate with and rest thereupon. Each adjusting screw mechanism 38 will have a support flange 48 associated therewith and the respective panelized wall construction 10 will be cooperatively received by the corresponding support flanges 48 along that portion of the foundation wall where that particular panelized construction will be utilized and attached. As best shown in FIG. 6, because of the shape and construction of the floor joist hangers 40, the floor joists do not interfere with the adjustment screw mechanism 38 and the support flange member 48 associated therewith.

Once any plurality of panelized wall structures 10 are positioned on top of a corresponding foundation wall, it is not uncommon that adjacent wall formations 10 will not be perfectly aligned due to dimensional or tolerance differences between the respective wall panels 10, or due to foundation defects or misalignments during the pouring process which may result in uneven upper foundation wall surfaces. These defects are easily corrected when using the present system by merely adjusting the appropriate adjustment screws 36 up or down so as to level one panelized wall construction 10 with an adjacent wall structure. Any particular panelized wall construction 10 will have a plurality of adjusting screws 36 positioned along the length of its bottom edge portion, adjustment of the wall formation 10 adjacent each opposite side edge portion thereof can be easily accomplished by adjusting the appropriate adjusting screws 36 where misalignment occurs. Precise correction in alignment is easily achieved independent of any foundation misalignments or other defects causing such misalignment due to the fact that each individual adjustment mechanism 36 along the length of the panelized construction 10 can be adjusted up or down to properly align one panelized construction 10 with adjacent constructions.

Use of the adjustment screws 36 yields a resulting gap 50 between the upper surface of the respective foundation walls and the bottom surface of each panelized wall construction 10 positioned and attached thereto as best illustrated in FIG. 6. Although the gap 50 is unconventional, it serves a number of beneficial functions. Besides allowing for adjustment of the adjustment screws 36 as discussed above, gap 50 also provides a convenient space for running electrical wires from one structure 10 to another structure 10 as well as to other portions of the overall building structure. In this regard, it is recognized that each panelized wall structure 10 may be fully equipped with fenestration, electrical outlets, and all appropriate wiring associated therewith. As such, the gap 50 allows adequate space for an electrical chase 51 for running all types of electrical wiring therewithin to other portions of the overall structure. In addition, the gap 50 also serves as a capillary break between the foundation wall and the panelized wall constructions 10 to prevent moisture seepage. Still further, an extra layer of insulation can be placed in the gap 50 to further insulate the overall structure and to prevent moisture seepage. For example, insulation in the form of the insulating foam 52 illustrated in FIG. 6 can be positioned in the gap 50 adjacent the exterior portion of the foundation wall for further protection. Insulation foam 52 can likewise be laced with an insecticide to prevent termites and for other pest control. Still further, the gap 50 allows the floor joist hangers 40 to be easily installed without interference with the panelized wall structures 10.

In areas of seismic activity, the adjusting screws 36 can be replaced or complimented with shock absorbers such as the shock absorber 54 illustrated in FIG. 5 to isolate the overall structure from the foundation wall. These shock absorbers may likewise include an adjustment mechanism for leveling and aligning the individual panelized wall constructions 10 relative to each other as explained above with respect to adjusting screw mechanism 36.

As discussed above, each block forming units 12, when constructed so as to be hollow as illustrated in FIGS. 2-4, contains a central void 34 within which may be packed insulation, such as a loose fill insulation or other insulation material, so as to further insulate the particular panelized wall construction 10. In addition, the central void 34 within each of the individual block forming units 12 can likewise be packed with various strength promoting devices for overall wall reinforcement and for support of overhead components. Still further, as indicated above, the block forming units 12 may likewise be constructed so as to be substantially solid.

Figure 7:
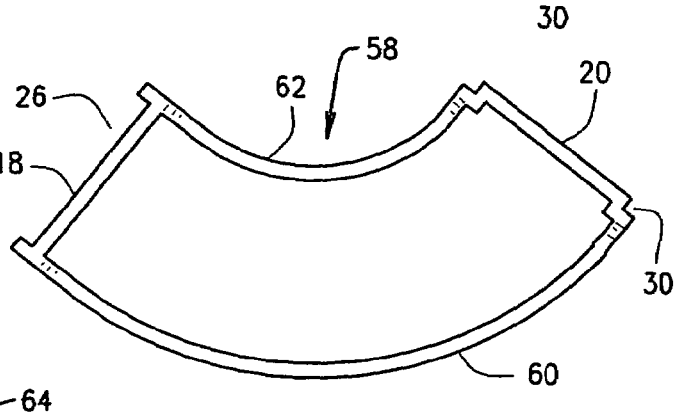
FIG. 7 is a fragmentary top plan view of an arcuate shaped block forming unit constructed in accordance with the teachings of the present invention.
Figure 8:
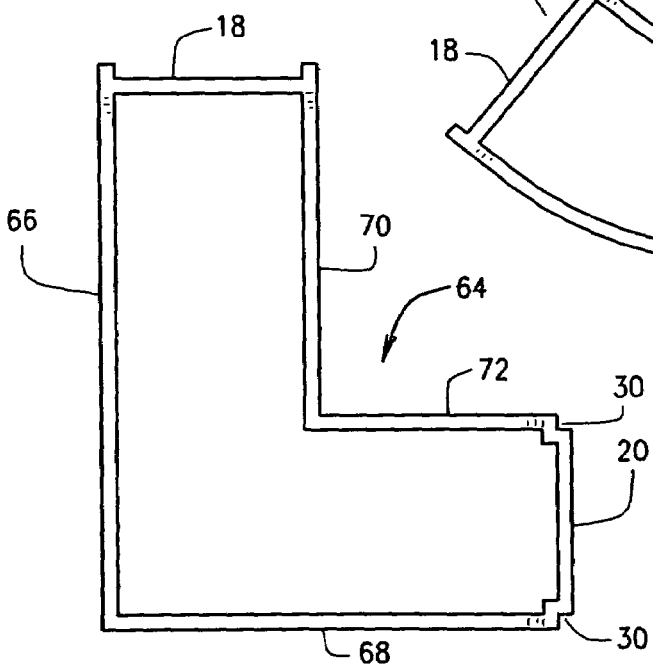
FIG. 8 is a top plan view of an L-shaped block forming unit constructed in accordance with the teachings of the present invention.

FIGS. 7 and 8 illustrate the fact that the present block forming unit 12 can likewise be extruded or otherwise formed in a wide variety of different shapes such as the arcuate shaped block forming unit 58 illustrated in FIG. 7 and the L-shaped block forming unit illustrated in FIG. 8. In FIG. 7, the front and rear wall portions 60 and 62 associated with the block forming unit 58 are suitably accurately configured, the remaining construction of the block 58 being substantially similar in all other respects to block forming unit 12 in that the respective opposite side portions thereof include the cooperatively engageable projection 20 and recess 26 as previously explained. Similarly, block forming unit 64 illustrated in FIG. 8 includes front wall portions 66 and 68 and rear wall portions 70 and 72 which form the L-shaped unit, the remaining construction of block forming unit 64 again being substantially similar to block forming unit 12 in that one side portion of block 64 includes the cooperatively receiving recess 26 whereas the opposite side portion includes the projection 20. Accordingly, the arcuate blocks 58 and/or the L-shaped blocks 64 can be interengaged with the planar blocks 12 or other coordinating arcuate blocks 58 or L-shaped blocks 64 in the same manner as previously described above with respect to the joinder of blocks 12 so as to achieve any particular overall wall configuration. Thus, it is readily apparent that the present invention is equally useful in the construction of walls of either circular form, or incorporating rounded or arcuate portions, or L-shaped or other angled portions. In this regard, the L-shaped block 64 can be constructed to achieve any angular orientation. It is recognized and anticipated that still other block configurations are possible and envisioned.

Figure 9:
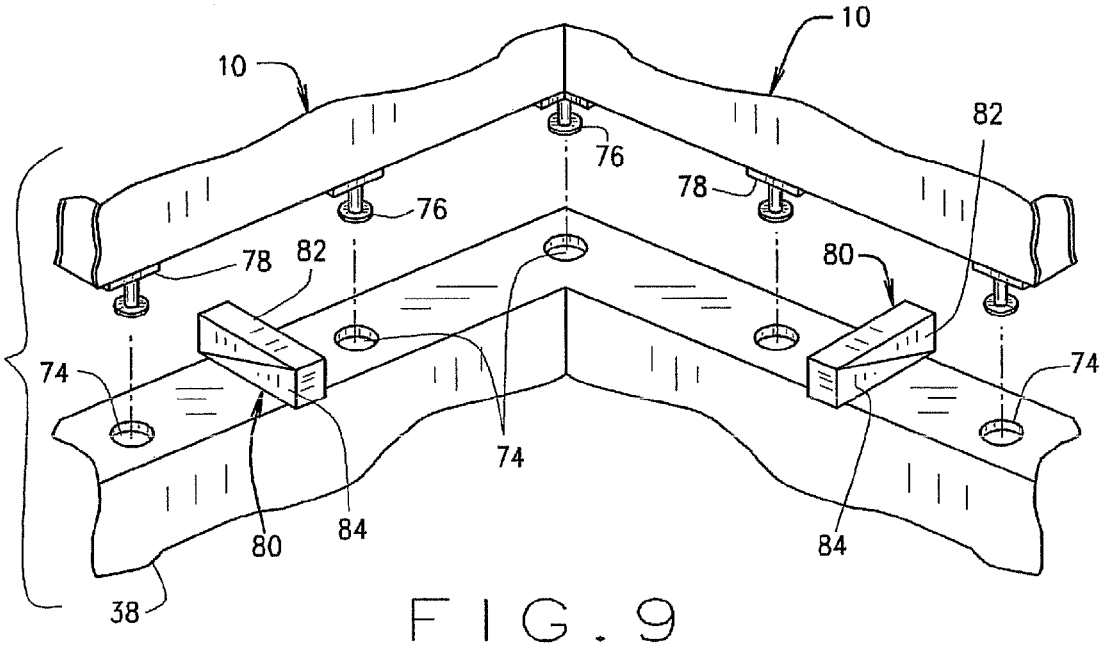
FIG. 9 is a fragmentary perspective view of another embodiment of the present system and method for installing a panelized wall system constructed in accordance with the teachings of the present invention onto a typical foundation wall.
Figure 10:
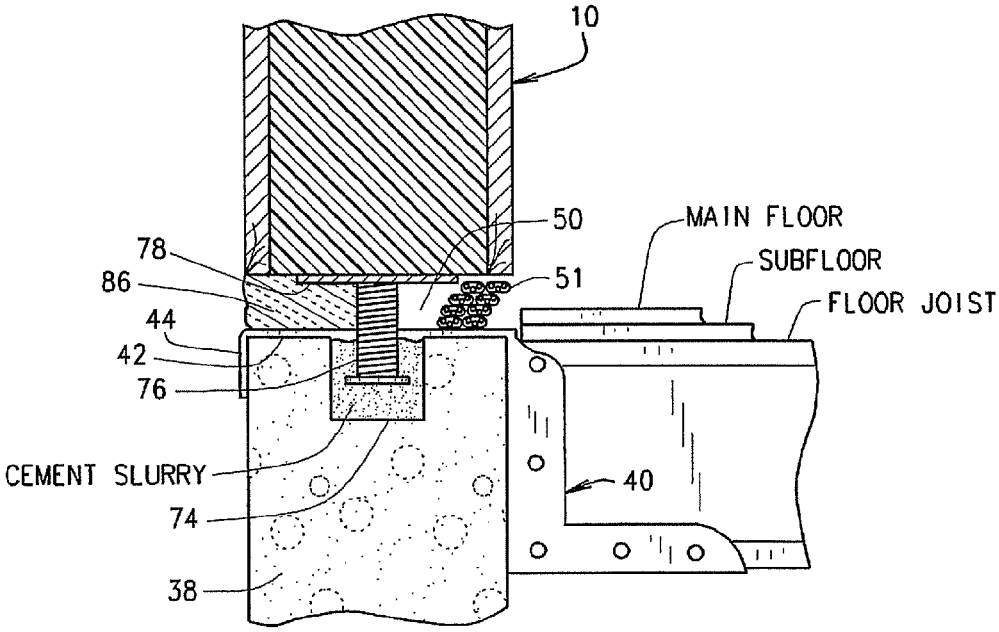
FIG. 10 is a partial side elevational view illustrating the method of the present invention of FIG. 9 for installing a panelized wall system constructed in accordance with the teachings of the present invention onto a typical foundation wall.

FIGS. 9 and 10 illustrate still another embodiment of the present system and method for assembling and integrating any plurality of pre-fabricated panelized wall formations or panel constructions constructed in accordance with the present invention onto a typical foundation wall. As illustrated in FIG. 9, the present system and method includes a plurality of spaced apart cavities 74 formed in the top portion of the foundation walls 38, each cavity 74 being adaptable for receiving a corresponding foot or downwardly projecting member 76 associated with the bottom edge portion of each respective panelized wall construction 10. The foundation cavities 74 are positioned and arranged in spaced apart relationship along the foundation walls 38 to which the panelized wall constructions 10 will be attached such that they will be in registration with and ready to receive the foot members 76 associated with each panelized wall construction 10 when such panel constructions 10 are positioned for attachment to the foundation walls 38. The number of foundation cavities 74 and corresponding foot members 76 may vary depending upon the size and weight of the wall constructions 10 which will be attached to the foundation walls 38.

As best illustrated in FIG. 10, each foot or downwardly projecting member 76 is associated with a support bracket 78 which can be easily attached to the bottom portion of each respective panelized wall construction 10. The support bracket 78 may include a substantially planar member attachable to the bottom portion of each respective panelized wall construction 10 in a conventional manner such as through the use of suitable fastening members, or the support bracket 78 can be U-shaped, L-shaped, or it can take on any other configuration compatible for attaching to the bottom edge portion of each panelized wall construction 10. In addition, the support brackets 78 are likewise positioned and spaced so as to correspond with the position and spacing of the foundation cavities 74 when the wall constructions 10 are located and positioned for attachment thereto. Each foundation cavity 74 is filled with a cement slurry and the respective panel wall constructions 10 are positioned over the foundation wall such that the corresponding foot members 76 are received within the foundation cavities 74 and are suspended therewithin until the cement slurry hardens.

In order to suspend the foot members 76 within the foundation cavities 74, wedge support blocks 80 are used to hold and support the panelized wall constructions 10 above the foundation walls 38 at the proper height to both level and align the panel section relative to an adjacent panel section and to allow the foot members 76 to extend into the cement slurry contained within the cavities 74 to the proper depth. Any number of wedge support blocks 80 can be positioned and used along the upper surface of the foundation walls 38 to adequately support the panelized wall constructions 10 while positioned thereon. The support blocks 80 are positioned and located between the foundation cavities 74 as illustrated in FIG. 9 and the spacing between the respective blocks 80 will likewise depend upon the size and weight of the specific wall formations 10 positioned thereon. Each wedge support block 80 includes wedge portions 82 and 84 as illustrated in FIG. 9 for adjusting the height of one panel section 10 relative to an adjacent panel section 10 such that each individual panel section 10 can be moved up or down relative to each other so as to properly align one panelized construction 10 with adjacent constructions. Alignment of the respective wall panels 10 relative to each other and relative to the foundation walls 38 can be easily accomplished by merely adjusting the plurality of wedge support blocks 80 positioned between the wall panels 10 and the foundation walls 38. This alignment is likewise achieved independent of any foundation misalignments or other defects causing such misalignment due to the fact that each individual wedge support block 80 can be adjusted up or down to properly align one panelized construction 10 with adjacent constructions.

Wedge support block portions 82 and 84 can be moved relative to each other when the panelized wall construction 10 is positioned thereon in a conventional manner such as by using a hammer or other object to move one wedge portion relative to the other portion. Once the cement slurry in each respective foundation cavity 74 is sufficiently hardened with the foot member 76 encapsulated therewithin as best illustrated in FIG. 10, the wedge support blocks 80 may be removed from between the panelized wall constructions 10 and the foundation walls 38. Anchoring and encapsulating the foot members 76 in the cement slurry not only supports the wall constructions 10 on top of the foundation walls 38, but it likewise helps to isolate movement of the individual wall panel sections 10 relative to the foundation walls 38.

FIG. 10 illustrates the attachment of a typical panelized wall construction 10 to a foundation wall 38. FIG. 10 also illustrates use of a typical floor joist hanger such as the floor joist hanger 40 previously described with respect to FIGS. 5 and 6. The floor joist hangers 40 include flange portions 42 and 44 as previously explained and are attached to the foundation walls 38 by conventional means well known in the industry as likewise previously explained with respect to FIGS. 5 and 6. Again, this floor joist construction does not interfere with the adjustment of the wedge support blocks 80 in the vertical direction as the support blocks 80 can be positioned between adjacent floor joist hangers 40. It is also recognized and anticipated that other floor joists hanger constructions adaptable for use with the present system which will not interfere with the adjustment of the wedge support blocks 80 can likewise be utilized. Once the floor joists hangers are installed, typical construction to include attachment of the floor joists and installation of the sub-floor and main floor are achieved in a conventional manner.

As with the system and method illustrated in FIGS. 5 and 6, this attachment method likewise results in a gap 50 being formed between the foundation walls 38 and the bottom edge portion of each respective panel wall section 10 as previously explained and as illustrated in FIG. 10. The gap 50 fulfills the same beneficial functions as referenced above with respect to FIGS. 5 and 6 including providing a convenient space for housing an electrical chase such as the electrical chase 51 for running all types of electrical wiring therewithin to other portions of the overall structure; for serving as a capillary break or moisture barrier between the foundation walls 38 and the panelized wall constructions 10 to prevent moisture seepage; and to provide extra insulation in the form of insulating foam such as the insulating foam 52 illustrated in FIG. 6 and/or a thermal gasket such as the thermal gasket 86 illustrated in FIG. 10. The insulation foam 52 or thermal gasket 86 provides additional protection and improves energy efficiency of the overall structure by blocking any pathway for unwanted air exchange between the inside and outside air. Regardless of any micro movements of the panelized wall construction 10 with respect to the foundation wall 38, any unwanted air paths or unwanted air flow leakage paths are closed and blocked by use of the insulation foam 52 or thermal gasket 86. Unwanted air infiltration is therefore avoided, and energy efficiency is improved along with indoor air quality and other energy and environmental factors. The gap 50 likewise allows the floor joist hangers 40 to be easily installed without interference with the panelized wall structures 10.

In areas of seismic activity, the foot members 76 can be complimented or replaced with shock absorbing members to further isolate the overall structure from the foundation wall. Some isolation is already achieved by the very fact that the foot members 76 are suspended within the cemented cavities 74. In addition, the support brackets 78 as well as the floor joists hangers 40 can likewise be designed so as to absorb shock in the event of seismic activity.

It is also recognized and anticipated that any panelized wall structure, even prior art structures already known in the industry, can likewise be utilized in conjunction with the present method for installing such wall structures in association with a typical foundation wall in accordance with the teachings of the present methods for installing a wall formation on top of a foundation wall.

The simplicity, durability, flexibility and versatility of the present block forming units 12, 58 and 64 greatly increase their usefulness and effectiveness for encouraging and promoting the use of panelized wall constructions. In addition, because each block forming unit is substantially identical in overall construction, the formation of a panelized wall construction lends itself to computerized construction wherein a "pick-and-place" robot can easily assemble a wall panel using CAD data. In addition, panelized wall constructions such as the wall construction 10 illustrated in FIG. 2 can be assembled in a controlled factory environment away from the actual construction site, thereby optimizing the engineering necessary in order to meet all structural and performance-based specifications associated with each panel section including fenestration, electrical outlets, loose-fill insulation, and other design parameters associated with a particular architectural plan for each wall section. The present block construction also lends itself to the use of a wide variety of different materials as explained above depending upon the particular application. Such materials may include particle board furnish, thermoplastics, and/or thermosetting materials with appropriate resins and binders including wood fibers which can be dried and coated appropriately for use in an extrusion process. It is also recognized and anticipated that still other manufacturing techniques and processes other than an injection molding or extrusion process can likewise be used depending upon the materials selected.

In addition, the present construction system is uniquely designed and is conducive to rapid, low-cost development of walls for private dwellings, as well as commercial and industrial establishments. The present system is likewise compatible with standard roof and floor systems and once the panelized wall constructions are placed in position as explained above, all other functions are completed using standard building processes including adding the roof trusses to the panelized wall constructions once they are positioned and anchored to the foundation walls as previously explained.

Thus, there has been shown and described a novel panelized wall construction system and the components therefore, including a novel method of attaching the panelized wall constructions to a typical foundation wall, which systems and method fulfill all of the objects and advantages sought therefor. Many changes, modifications, variations and other uses in applications of the present block forming units and method of attaching the same will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A method for attaching a wall formation to a foundation wall comprising:

providing a pre-fabricated wall formation for attachment to a foundation wall;

forming a plurality of cavities in spaced apart relationship along the upper surface of the foundation wall to which the wall formation will be attached;

providing a plurality of foot members associated with the bottom portion of the wall formation, said foot members being positioned in spaced apart relationship so as to correspond with the spacing of said foundation cavities when the wall formation is positioned over said foundation wall;

positioning at least two support blocks on the upper surface of the foundation wall at a location between said plurality of cavities;

filling each of said cavities with a cement slurry;

positioning the wall formation on top of said at least two support blocks such that said foot members are received within said cavities and within said cement slurry;

allowing the cement slurry to harden; and removing said at least two support blocks after the cement slurry has hardened such that a gap exists between the bottom portion of the wall formation and the upper surface of the foundation wall.

2. The method defined in claim 1 wherein each foot member is associated with a respective support bracket, each support bracket being attached to the bottom portion of the wall formation.

3. The method defined in claim 1 wherein each support block includes adjustment means for moving the wall formation positioned thereon up and down in a vertical direction.

4. The method defined in claim 3 wherein said adjustment means includes a pair of wedge shaped portions forming each support block, each wedge shaped portion being movable relative to each other.

5. The method defined in claim 1 wherein said gap is sufficient to provide for an electrical chase between the upper portion of the foundation wall and the bottom portion of the wall formation.

6. The method defined in claim 1 wherein said gap serves as a moisture barrier to prevent moisture seepage between the foundation wall and the wall formation.

7. The method define in claim 1 including the following step:

providing insulation within at least a portion of said gap.

8. The method defined in claim 7 wherein said insulation is laced with an insecticide.

9. The method defined in claim 1 including the following step:

providing a thermal gasket within at least a portion of said gap.

10. The method defined in claim 1 including the following step:

providing a floor joist hanger attachable to the foundation wall within said gap, said floor joist hanger being positioned and configured so as not to interfere with said plurality of cavities and said plurality of foot members receivable therein.

11. The method defined in claim 1 wherein said wall formation is formed by a plurality of block forming units.

12. The method defined in claim 11 wherein said plurality of block forming units are both vertically arranged one on top of the other and horizontally arranged in side-by-side relationship to form the wall formation.

13. The method defined in claim 12 wherein each of said block forming units includes first and second opposed side wall portions and first and second opposed end wall portions, said first side wall portion including a projecting planar surface extending substantially the full length of said unit, said second side wall portion including a recess adaptable for receiving said planar surface, said first and second end wall portions being substantially similar in construction, said first end wall portion being adapted for mating substantially flush with the second end wall portion of a similarly constructed unit, said plurality of block forming units being vertically and horizontally interconnected to each other by adhesive means.

14. A method for attaching a wall formation to a foundation wall comprising:

providing a pre-fabricated wall formation for attachment to a foundation wall;

forming a plurality of cavities in spaced apart relationship along the upper surface of the foundation wall to which the wall formation will be attached;

providing a plurality of foot members associated with the bottom portion of the wall formation, said foot members being positioned in spaced apart relationship so as to correspond with the spacing of said foundation cavities when the wall formation is positioned over said foundation wall;

positioning at least two support blocks on the upper surface of the foundation wall for engagement with the bottom portion of the wall formation, each support block being adjustable so as to move the wall formation when positioned thereon up or down in a vertical direction;

filling each of said cavities with a cement slurry;

positioning the wall formation on top of said at least two support blocks such that said foot members are received within said cavities and within said cement slurry;

adjusting said support blocks so as to align the wall formation with any adjacent wall formation or other structure;

allowing the cement slurry to harden; and removing said at least two support blocks after the cement slurry has hardened such that a gap exists between the bottom portion of the wall formation and the upper surface of the foundation wall.

15. The method defined in claim 14 wherein each support block includes a pair of at least two wedge shaped portions which are movable relative to each other, movement of said at least two wedge shaped portions causing the wall formation positioned thereon to move in a vertical direction.

16. The method defined in claim 14 wherein each foot member is associated with a respective support bracket, each support bracket being attached to the bottom portion of the wall formation.

17. A method for attaching a wall formation to a portion of a foundation wall comprising:

providing a plurality of block forming units, each of said block forming units including first and second opposed side wall portions and first and second opposed end wall portions, said first side wall portion including a projecting planar surface extending substantially the full length of said unit, said second side wall portion including a recess adapted for cooperatively receiving said planar surface, said first and second end wall portions being substantially similar in construction, said first end wall portion being adapted for mating substantially flush with the second end wall portion of a similarly constructed unit;

assembling the wall formation from said plurality of block forming units by applying an adhesive to the appropriate side wall and end wall portions of each block forming unit and thereafter vertically and horizontally arranging said block forming units one on top of the other and in side-by-side relationship to form the wall formation;

forming a plurality of cavities in spaced apart relationship along the upper portion of the foundation wall to which the wall formation will be attached;

providing a plurality of foot members associated with the bottom portion of the wall foundation, said foot members being positioned and located so as to extend into said cavities when the wall formation is positioned over the foundation wall;

positioning a plurality of adjustment mechanisms in spaced apart relationship along the upper surface of the foundation wall to which the wall formation will be attached, said adjusting mechanisms being movable so as to cause the wall formation to move up or down when positioned thereon;

filling each of said cavities with a cement slurry;

positioning the wall formation on top of said plurality of adjustment mechanisms such that each foot member is received in a corresponding cavity and is suspended in the cement slurry;

adjusting said plurality of adjustment mechanisms before the cement slurry hardens so as to align the wall formation positioned thereon with any adjacent wall formation or other structure;

allowing the cement slurry to hardened with the foot members suspended therein; and removing the adjustment mechanisms after the cement slurry hardens such that a gap exists between the bottom portion of the wall formation and the upper surface of the foundation wall.

18. The method defined in claim 17 wherein each adjustment mechanism includes a support block having at least two wedge shaped portions which are movable relative to each other.

19. The method defined in claim 17 wherein said gap is sufficient to provide for an electrical chase between the upper portion of the foundation wall and the bottom portion of the wall formation.

20. The method defined in claim 17 wherein said gap serves as a capillary break to prevent moisture seepage between the foundation wall and the wall formation.

21. The method defined in claim 17 including the following step:

providing insulation within at least a portion of said gap.

22. The method defined in claim 21 wherein said insulation is laced with an insecticide.

23. The method defined in claim 21 wherein said insulation is a thermal gasket.

24. The method defined in claim 17 including the following step:

providing a floor joist hanger attachable to the foundation wall within said gap.

25. The method defined in claim 17 including the following step:

providing shock absorber means between the wall formation and the foundation wall to further isolate the wall formation from the foundation wall.

* * * * *